US006971761B2

(12) United States Patent
Parsons

(10) Patent No.: US 6,971,761 B2
(45) Date of Patent: Dec. 6, 2005

(54) PROTECTIVE FLASHLIGHT CASE

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 3 days.

(21) Appl. No.: 10/626,276

(22) Filed: Jul. 24, 2003

(65) Prior Publication Data

US 2005/0018419 A1 Jan. 27, 2005

(51) Int. Cl.[7] ..... F21L 4/00
(52) U.S. Cl. ..... 362/158; 362/116; 362/154; 362/204; 206/216; 206/573
(58) Field of Search ..... 362/116, 158, 196, 362/200, 204, 205, 206, 154; 206/216, 573

(56) References Cited

U.S. PATENT DOCUMENTS 2,832,968 A * 5/1958 Valdemar ..... 441/16
3,042,796 A * 7/1962 De Forest ..... 362/158
3,601,601 A * 8/1971 Eilenberger ..... 362/158
4,342,071 A * 7/1982 Chamberlain ..... 362/158
4,905,130 A * 2/1990 Huang ..... 362/203
5,463,539 A * 10/1995 Vandenbelt et al. ..... 362/189
5,469,345 A * 11/1995 Pettersen et al. ..... 362/188
5,720,543 A * 2/1998 Sheps ..... 362/196
6,190,018 B1 2/2001 Parsons et al. ..... 362/116
6,299,323 B1 * 10/2001 Yu et al. ..... 362/116
6,793,366 B2 * 9/2004 Chun ..... 362/184

OTHER PUBLICATIONS

PctUS 94/12491 Leake et al. (A transparent electrical device powered by decorative batteries that are viewed through the device), the flashlight having a first and second body portion.*

* cited by examiner

*Primary Examiner*—John Anthony Ward
(74) *Attorney, Agent, or Firm*—Welsh & Katz, Ltd.

(57) ABSTRACT

A protective flashlight case includes left and right pieces with front and rear ends. The rear ends of the two case pieces are formed in a closed loop shape so as to enclose a key ring clip of a flashlight. A hollow space defined by the walls of the loop permits the case, with the flashlight enclosed, to be attached to a key chain, article of clothing, or other support. The case protects flashlights from harsh, rugged conditions as well as from water.

19 Claims, 3 Drawing Sheets

PROTECTIVE FLASHLIGHT CASE

BACKGROUND OF THE INVENTION

The present invention is directed to a protective flashlight case. More particularly, the present invention is directed to a waterproof flashlight case formed from two pieces and having integral loop and mounting clip attachments.

Conventional flashlights are well known in the art, and are often used for a wide variety of law enforcement and civilian purposes. Generally, conventional flashlights employ an incandescent light bulb and dry cell batteries in a housing typically having an elongated cylindrical body section and a head section. Flashlights of this type are often bulky and cumbersome.

Small, compact, hand-held LED flashlights using coin-type battery power sources alleviate the weight and bulk of traditional flashlights. See, for example, U.S. Pat. No. 6,190,018 and U.S. patent application Ser. No. 10/066,554, both assigned to the assignee of the present invention and incorporated herein by reference. Such small, lightweight flashlights easily may be carried on one's person, allowing users a significant increase in mobility. Some are adapted to attach to a key chain or clothing, such as buttonholes, belt loops, or lifejackets.

The small size and weight of LED flashlights are useful to many different types of users. Law enforcement personnel are required to carry flashlights in addition to many other bulky pieces of equipment. Small, lightweight flashlights are less burdensome for law enforcement personnel to carry, and are less likely to be purposefully left behind because they are inconvenient. Many individuals carry flashlights when walking alone at night, or when returning to one's car during darkness. A small, pocket or purse-sized LED flashlight is much more convenient to carry, and much less likely to be forgotten or left behind.

Avid sport participants also find small LED flashlights very helpful. Runners, especially those who run at night in urban settings, find that lights improve their visibility to surrounding traffic. Hikers use lights not only to better see their surroundings in low light, but to be seen by companions as well. Participants in water sports, such as those involved in sailing, canoeing, rafting, kayaking, and the like, may utilize lights to improve their visibility and to signal for help, such as by signaling S.O.S., if a rescue should become necessary.

Parents may use integrated flashlight clips to attach small LED lights to their children to make them more visible when waiting for the bus during early morning hours, or when walking to school. Small lights also may be valuable in natural disasters, as they may draw the attention of rescuers.

Small, LED flashlights are considerably more manageable and convenient to carry than conventional flashlights, but they are relatively vulnerable to breakage under rugged, harsh, or sporting conditions. Spring-biased or split-ring clips, which normally attach the compact lights to key chains or clothing, may break under harsh conditions. Although LED flashlight bodies are fairly strong, they may nonetheless be smashed or crushed. Additionally, when exposed to water, such LED flashlights may short-circuit and fail to function.

Accordingly, a protective case for small, compact LED flashlights is needed. It is desirable that such a case fully enclose the flashlight, including any clip attachment, thus allowing the flashlight case with the flashlight enclosed, to be attached to key chains or clothing. In this way, the flashlights may remain operable while in the case, emitting visible light, while being protected by the case. Further, there is a need for a waterproof case to protect the LED flashlight to permit users to take such LED flashlights onto beaches or in water without fear of flashlight failure. An additional mounting clip desirably is included to facilitate attachment of the case to a support, such as a hat brim or belt.

BRIEF SUMMARY OF THE INVENTION

A protective flashlight case includes right and left body portions with front and rear ends, as well as inner and outer walls. The rear ends of the two body portions are formed in a closed loop shape so as to enclose a key ring clip of the flashlight. A hollow space defined by the walls of the loop allows an enclosed flashlight to be attached to a key chain, article of clothing, or other support.

In a preferred embodiment, the hollow space formed by the walls of the loop portion is generally triangular shaped. The front ends of the two body portions include an arcuate protuberance for accommodating the LED light source of the flashlight.

In one embodiment, the outer wall of one of the body portions includes an opening for allowing users to operate the ON/OFF switch of the enclosed LED flashlight. Preferably, the opening forms a liquid tight seal around the switch of the enclosed flashlight. The opening may be circular in shape to accommodate a similarly shaped switch of the flashlight. The case may be formed of high-impact and/or waterproof material, and may be transparent to allow the light generated by the LED flashlight to pass therethrough. Alternatively, the case may be translucent or may be colored.

In another embodiment, the flashlight case includes a generally U-shaped mounting clip on the outer wall of the right body portion. Preferably, the mounting clip is configured to grasp an article of clothing, such as a hat brim or belt. The rearward ends of the body portions may include a slot to facilitate opening of the case. When the case is closed, a coin or other thin object may be inserted into the slot to permit the user to pry apart the two body portions.

Further objects, features, and advantages of the present invention, together with the organization and manner of use thereof, will become apparent from the following description of the invention when taken in conjunction with the accompanying drawings, wherein like reference numerals designate like elements throughout the several views.

While the present invention is susceptible to various modifications and alternative forms, specific embodiments thereof are shown by way of example in the accompanying drawings and will be described in detail. It should be understood that the drawings and detailed description thereof are not intended to limit the invention to the particular form disclosed, but rather the invention is intended to cover all modifications, equivalents, and alternatives falling within the spirit and scope of the present invention.

DETAILED DESCRIPTION OF THE INVENTION

Figure 1:
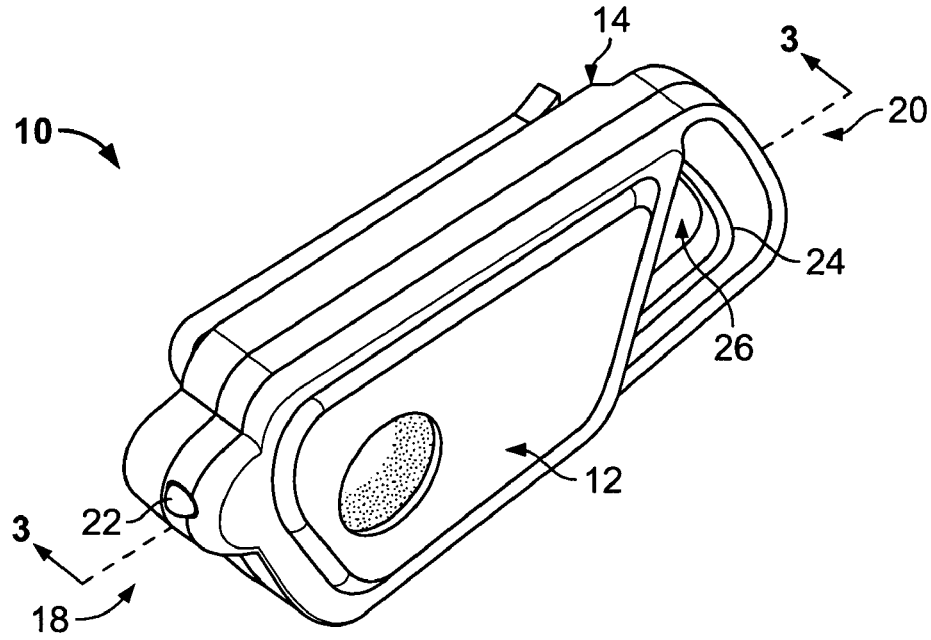
FIG. 1 is a perspective view of a protective flashlight case in accordance with a specific embodiment of the present invention, shown in operation enclosing an LED flashlight.

Referring now to FIG. 1, a protective flashlight case 10 is shown in a "closed" position in accordance with the principles of the present invention. The flashlight case 10 includes a left body portion 12 and a right body portion 14. Note that reference to a "left body portion" may be interchanged with "right body portion" or may be termed "first" and "second" body portions without departing from the scope and spirit of the invention. The flashlight case 10 is configured to enclose a small, compact, LED flashlight, such as the type of flashlight 16 shown in FIG. 6. The flashlight 16 may include a side cover 17, a power source frame housing 19, a keyring extension 32, a keyring lock 21, a switch button 42, and a light source 22, which light source extends from a front end of the flashlight.

Figure 2:
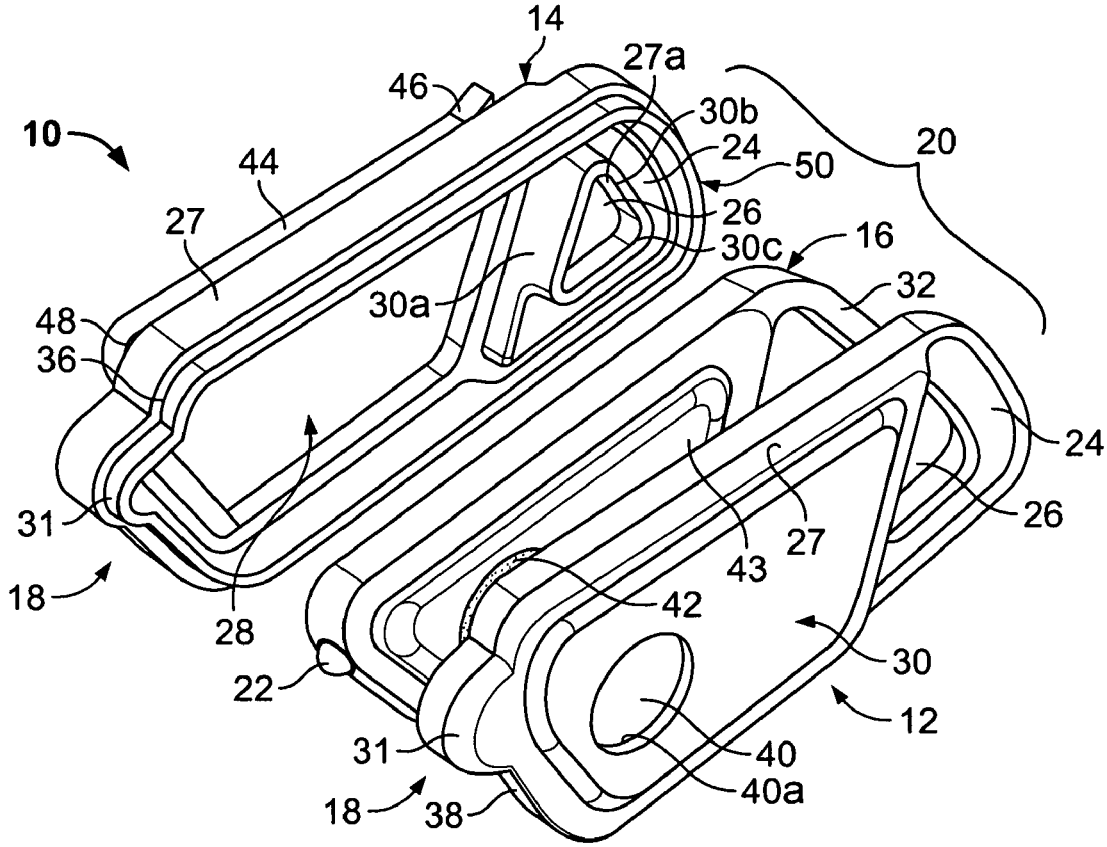
FIG. 2 is an exploded perspective view of the case and the enclosed flashlight of FIG. 1.
Figure 3:
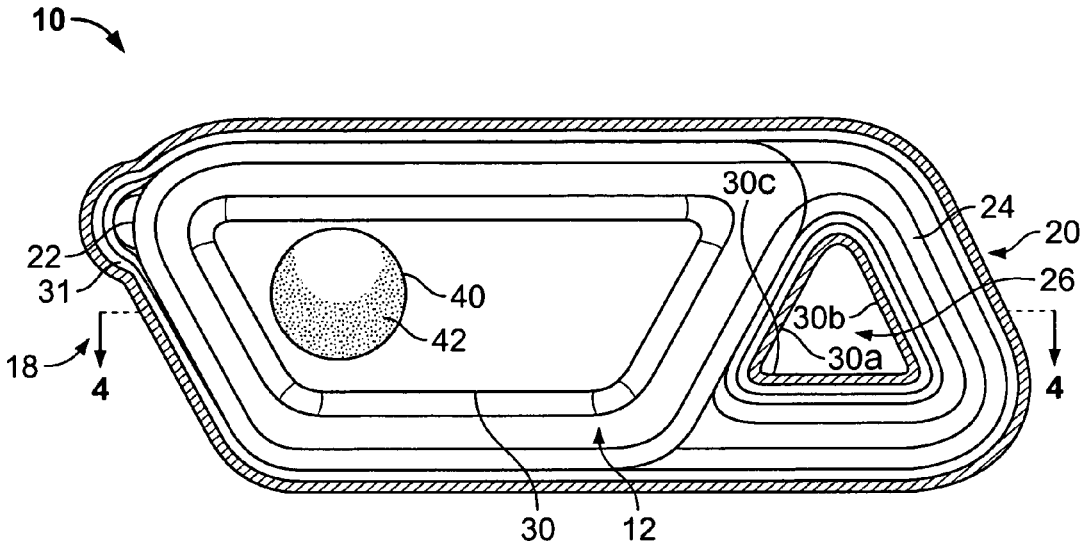
FIG. 3 is an enlarged plan view of a left side of the flashlight case, taken along line 3—3 of FIG. 1.
Figure 6:
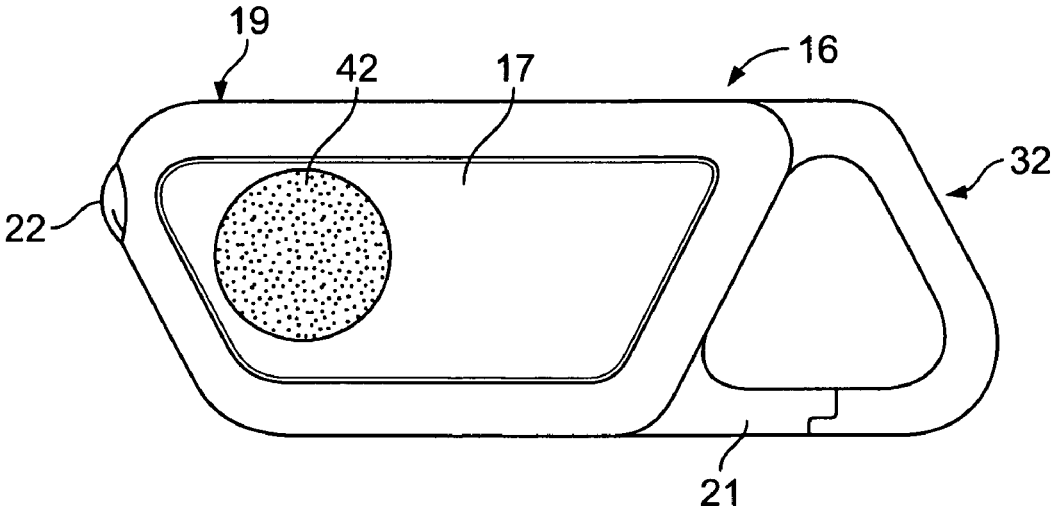
FIG. 6 is a perspective view of a typical known LED flashlight that may be enclosed within the present invention.

Referring now to FIG. 2, the flashlight case 10 is shown in an "open" or separated position, with the flashlight 16 of FIG. 6 shown between the left 12 and right 14 body portions. The left 12 and right 14 body portions preferably are formed of a transparent, plastic material that allows the LED's light to shine through the case 10. The case 10 is preferably formed from molded sections, the material of which may be colored or colorless as long as the light from the LED or other light source may be seen through the case 10. If the material is colored, it is preferably molded in "safety" colors. If the material is clear or sufficiently translucent, a panel 43 of the flashlight 16 enclosed within the flashlight case 10 is visible to the user. Such panels 43 may be decorated with various designs, graphics, insignia, indicia, and may colored, which colors may be readily discernable to the user viewing the case and flashlight. Preferably, the material is a plastic material, such as polycarbonate, which is waterproof and impact resistant. However, any suitable plastic or other material may be used. Preferably, the left 12 and right 14 body portions are formed as generally mirror images of each another (except for opening 40 and sealing edges, described below), and may be of a generally parallelogram shape.

The left 12 and right 14 body portions each have a forward end 18 and a rearward end 20, as well as inner 28 and outer 30 surfaces. The forward ends 18 each include an arcuate protuberance 31 integrally formed in each of the body portions 12, 14, which is configured to receive and enclose the flashlight light source 22, which typically protrudes or extends from the edge of the flashlight.

Each body portion 12, 14 is circumscribed by an upstanding continuous perimeter side wall 27, which is integrally formed with the body portion. The perimeter side wall 27 on the left body portion 12 is complementary to perimeter side wall on the right body portion to facilitate sealing engagement of the body portions 12, 14. The perimeter side walls 27 also define the hollow area or space between the body portions 12, 14 when the body portions are snap-fitted together. The hollow portion thus formed is configured to receive and enclose the LED flashlight, including the keyring extension portion 32 of the LED flashlight.

The rearward ends 20 of each body portion includes an upstanding internal sidewall 30*a* that partially separates or divides the body portion to define the forward end and the rearward end. The upstanding internal side wall 30*a* further cooperates with a second 30*b* and a third 30*c* internal side wall segment that together form a continuous, closed, internal, triangular-shaped side wall. The three upstanding internal side wall segments 30*a*, 30*b*, 30*c* are continuous and are formed from a portion of the body portion 12, 14.

The material comprising the body portion, however, does not extend within the interior defined by the internal side walls segments 30*a*, 30*b*, and 30*c*. Therefore, a hollow space 26 is created and defined by the continuous internal side walls segments. The three continuous internal side walls segments 30*a*, 30*b*, 30*c*, in conjunction with the perimeter side wall 27 of the body portions define and form a loop portion 24 of the flashlight case 10, wherein the second 30*b* and third 30*c* internal side wall segments are spaced apart from, and are generally parallel to the perimeter contour of the body portion.

Further, the loop portion 24 of each body portion 12, 14 defines a channel having a semicircular cross-section. However, the cross-section need not be substantially semicircular, and may have flattened areas. It may also be rectangular, and the like. When the left and right body portions 12, 14 are brought together, the internal sidewall segments 30*a*, 30*b*, 30*c* meet in facing engagement thus forming a hollow enclosed "loop" configured to receive and enclose the keyring extension 32 portion of the LED flashlight 16 when the flashlight is sealingly disposed between the body portions.

When the LED flashlight 16 is enclosed between the left and right body portions 12, 14 and the body portions are "snap-fit" together, the keyring extension 32 portion of the LED flashlight 16 is not directly accessible through the case 10. However, the user may continue to attach the flashlight case 10 and the enclosed flashlight 16 to articles of clothing such as buttonholes, belt loops, lifejackets or other support via the loop portion 24 and hollow space 26 defined therein.

For example, a metal split ring (not shown) may be separated so as to wrap around the loop portion 24, which split ring may then also attach to the article of clothing. When the LED flashlight 16 is enclosed within the case 10, the flashlight is protected from damage or breakage in rugged or harsh conditions. The LED flashlight 16 is also protected from water because the left and right body portions form a water-tight seal and do not permit water to enter. Of course, the waterproof capabilities of the flashlight case 16 are not unlimited, and the case is not meant to be submerged underwater at a great depth. Nonetheless, the flashlight case 10 is designed to prevent ingress of water for a limited period of time should the case be submerged in several feet of water. The flashlight case 10 is very well suited to protecting the flashlight from water in a rain storm, for example, or other inclement whether.

Figure 5:
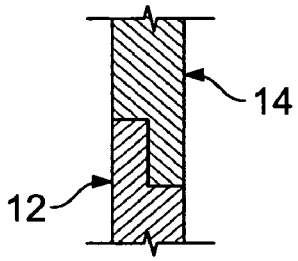
FIG. 5 is an enlarged cross-sectional view illustrating the mating of raised cooperating sealing edges, shown in circled dotted lines on FIG. 4.

The perimeter side wall 27 of the right body portion 14 has a raised sealing edge 36 along its inner surface 28, which is configured to cooperate and snap-fit with a corresponding recessed sealing edge 38 formed in the corresponding perimeter side wall 27 of the left body portion 12. Once the raised sealing edge 36 of the right body portion 14 is snap-fitted with the recessed sealing edge 38 of the left body portion 12, a waterproof seal is formed. The mating of the sealing edges is shown in greater detail in FIG. 5.

Note also that the three upstanding internal side wall segments 30*a*, 30*b*, 30*c* also include the same sealing edge arrangement. Thus, when the body portions are brought together in sealing engagement, not only do the perimeter side walls 27 mate and seal, but the internal side walls 30*a*,

30*b*, 30*c* also sealingly mate. This in conjunction with the perimeter side wall 26 provide a complete waterproof seal around the case 10.

Note that left body portion 12 is not an exact mirror-image of the right body portion 14 in that it further includes an opening 40 in the outer surface 30 located toward the forward end 18, which opening is preferably circular in shape. The opening 40 is configured to align with and seal around the switch button 42 of the flashlight, which button may be made of a flexible or elastomeric material. The opening 40 includes a slight beveled edge 40*a* about its inside perimeter. When the LED flashlight 16 is enclosed between the left and right body portions 12, 14 and the body portions are snap-fitted together, the LED flashlight is slightly compressed between the body portions and against the inside surface of the perimeter side wall 27. The opening 40 contacts the switch button 42 and forms a waterproof seal therewith, thus permitting the user to activate and deactivate the flashlight 16 by depressing the switch button while the flashlight is protectively enclosed within the waterproof case.

More particularly, the left and right surfaces of the LED flashlight contact corresponding inside surfaces 28 of the body portions 12, 14. This causes the material of the switch button 42 of the flashlight to be pressed against the beveled wall 40*a* of the opening creating an interference fit, which in turn, creates a water-tight seal between the switch button 42 and the opening 40. According, the switch button 42 may be actuated when the LED flashlight is sealingly disposed within the body portions 12, 14.

Figure 4:
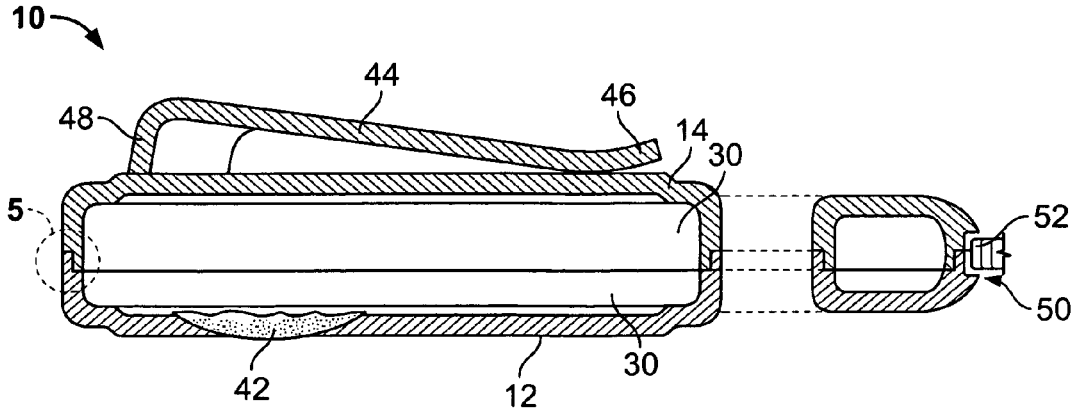
FIG. 4 is a side sectional view of the flashlight case, taken along line 4—4 of FIG. 3.

Turning to FIG. 4, the right body portion 14 outer surface 30 may include an integrally formed mounting clip 44. Preferably, the mounting clip 44 is generally U-shaped. The mounting clip 44 facilitates attachment of the case 10 to a support, such as a hat brim, a watch strap, a belt, or other articles of clothing or baggage. The mounting clip 44 has an upwardly turned or rounded free edge 46 that may be have a diagonal contour so as to follow the contour defined by a leg of the triangular-shaped loop portion 24 (FIG. 2.). The rounded free edge 46 facilitates easy attachment to the hat brim, for example. The mounting clip 44 is integrally formed with the outside surface 30 of the right body portion 14, however, it may be formed with or otherwise attached to either body portion. The mounting clip 44 is preferably connected to the body portion by an arcuate portion 48 that curves through an arc of about ninety degrees. However, the amount of curvature may be slightly less than ninety degrees so that the mounting clip 44 has a downward slope relative to the outside surface 30 of the body portion 14. Any suitable degree of curvature may be employed. The mounting clip permits the case 10 and enclosed LED flashlight 16 to be mounted on a suitably convenient support, such as a hat brim to allow for hands-free operation of the flashlight.

Further, as shown in FIG. 4, the rearward ends 20 of the left 12 and right 14 body portions include a slightly cut-away or recessed area disposed adjacent the raised sealing edge 36. Thus, when the left 12 and right 14 body portions are snap-fitted together, the cut-away portions form a slot 50 that facilitate opening the case by inserting a coin or other thin object 52 into the slot and twisting the coin to pry apart the left 12 and right 14 body portions.

While a preferred embodiment of the protective flashlight case in accordance with the present invention has been illustrated and described, it will be understood that changes in modifications may be made therein without departing from the invention in its broader aspects. various features of the invention are defined in the following claims, and all modifications, variations, or equivalents that fall within the true spirit and scope of the basic underlying principles of the invention are intended to be encompassed in the following claims.

What is claimed is:

1. A protective flashlight case in which to removably enclose a flashlight having a key ring extension portion, the case comprising:

a first body portion having a forward end and a rearward end;

the first body portion having an integrally formed continuous side wall with a first sealing edge and defining a first opening having a second sealing edge thereabout, the first opening defined adjacent the rearward end;

a second body portion having a forward end and a rearward end;

the second body portion having an integrally formed continuous side wall with a first sealing edge and defining a second opening having a second sealing edge thereabout, the second opening defined adjacent the rearward end;

the first and second sealing edges configured to releasably mate and form a water resistant seal while mated so as to sealingly enclose the flashlight and define a sealed opening therethrough adjacent the rearward end.

2. The flashlight case in accordance with claim 1 wherein the sealed opening has a generally triangularly shaped cross-section.

3. The flashlight case in accordance with claim 1 wherein at least one of the forward ends of the first and second body portions defines a protuberance configured to contain the light source of a flashlight.

4. The flashlight case in accordance with claim 1 further defining another opening having a sealing element, disposed in one of the body portions, configured to permit a user to directly activate a switch button of the flashlight while maintaining the water resistant seal.

5. The flashlight case in accordance with claim 4 wherein the opening includes a beveled edge to facilitate maintaining the water resistant seal of the flashlight case.

6. The flashlight case in accordance with claim 4 wherein the opening has a circular cross-section.

7. The flashlight case in accordance with claim 1 wherein the first and second body portions are made of a high-impact plastic material.

8. The flashlight case in accordance with claim 1 wherein the first and second body portions are made of a water resistant material.

9. The flashlight case in accordance with claim 1 wherein the first and second body portions are made of transparent, colorless materials.

10. The flashlight case in accordance with claim 1 wherein at least one of the body portions are made of a transparent, colored material.

11. The flashlight case in accordance with claim 1 further including a mounting clip integrally formed on at least one of the first and second body portions.

12. The flashlight case in accordance with claim 11 wherein the mounting clip is generally U-shaped.

13. The flashlight case in accordance with claim 9 wherein a panel portion of the flashlight enclosed within the case is visible through the transparent material of the case.

14. The flashlight case in accordance with claim 13 wherein designs, graphics, insignia, indicia, and/or colors of the panel portion of the flashlight are visible through the case.

15. The flashlight case in accordance with claim 11 wherein the mounting clip is configured to be attached to an article of clothing.

16. The flashlight case in accordance with claim 1 including a slot defined in at least one of the rearward ends of the body portions to facilitate separating the body portions when mated.

17. A protective flashlight case in which to removably enclose a flashlight having a key ring extension portion, the case comprising:

a first body portion, made of plastic, having a forward end and a rearward end;

the first body portion having an integrally formed continuous side wall with a first sealing edge and defining a first opening having a second sealing edge thereabout, the first opening defined adjacent the rearward end;

a second body portion, made of plastic, having a forward end and a rearward end;

the second body portion having an integrally formed continuous side wall with a first sealing edge and defining a second opening having a second sealing edge thereabout, the second opening defined adjacent the rearward end;

the first and second sealing edges configured to releasably mate and form a water resistant seal while mated so as to sealingly enclose the flashlight and define a sealed opening therethrough adjacent the rearward ends; and at least one of the forward ends of the first and second body portions defines a protuberance configured to contain the light source of a flashlight.

18. A protective flashlight case in which to removably enclose a flashlight having a key ring extension portion, the case comprising:

a first body portion, made of plastic, having a forward end and a rearward end;

the first body portion having an integrally formed continuous side wall with a first sealing edge and defining a first opening having a second sealing edge thereabout, the second opening defined adjacent the rearward end;

a second body portion, made of plastic, having a forward end and a rearward end;

the second body portion having an integrally formed continuous side wall with a first sealing edge and defining a second opening having a second sealing edge thereabout, the second opening defined adjacent the rearward end;

the first and second sealing edges configured to releasably mate and form a water resistant seal while mated so as to sealingly enclose the flashlight and define a sealed opening therethrough adjacent the rearward end; and another opening having a sealing element disposed in one of the body portions configured to permit a user to directly activate the flashlight while maintaining the water resistant seal.

19. A protective flashlight case in which to removably enclose a flashlight, the case comprising:

a first body portion having a forward end and a rearward end;

the first body portion having an integrally formed continuous side wall with a first sealing edge;

a second body portion having a forward end and a rearward end;

the second body portion having an integrally formed continuous side wall with a second sealing edge;

the first and second sealing edges configured to releasably mate and form a water resistant seal while mated so as to sealingly enclose the flashlight; and an opening, having a sealing element, defined in one of the body portions, the opening configured to permit a user to directly activate the flashlight while maintaining the water resistant seal of the first and second sealing edges.

* * * * *